US006543140B1

(12) United States Patent
Davis

(10) Patent No.: US 6,543,140 B1
(45) Date of Patent: Apr. 8, 2003

(54) UTILITY KNIFE HAVING IMPROVED BLADE CARRIER STRUCTURE AND METHOD OF MANUFACTURE THEREOF

(75) Inventor: Raymond E. Davis, Garland, TX (US)

(73) Assignee: Adco Industries, Garland, TX (US)

( * ) Notice: Subject to any disclaimer, the term of this patent is extended or adjusted under 35 U.S.C. 154(b) by 0 days.

(21) Appl. No.: 09/610,253

(22) Filed: Jul. 5, 2000

(51) Int. Cl.[7] ..... B26B 1/08
(52) U.S. Cl. ..... 30/2; 30/162; 30/335
(58) Field of Search ..... 30/2, 151, 162, 30/286, 289, 293, 294, 142, 143, 335

(56) References Cited

U.S. PATENT DOCUMENTS

| | | | | | |
|---|---|---|---|---|---|
| 1,108,839 | A | * | 8/1914 | Foley | 30/289 |
| 2,748,478 | A | * | 6/1956 | Shelton | 30/289 |
| 2,889,623 | A | * | 6/1959 | Baker | 30/2 |
| 3,781,988 | A | | 1/1974 | Jones | |
| 4,031,616 | A | | 6/1977 | Hines et al. | |
| 4,086,698 | A | | 5/1978 | Sparks | |
| 4,091,537 | A | * | 5/1978 | Stevenson, Jr. | 30/286 |
| 4,503,612 | A | | 3/1985 | Davis | |
| 4,531,286 | A | | 7/1985 | Vito et al. | |
| 4,675,996 | A | | 6/1987 | DuBuque | |
| 4,744,146 | A | | 5/1988 | Schmidt | |
| 4,748,743 | A | * | 6/1988 | Anderson et al. | 30/162 |
| 4,980,977 | A | | 1/1991 | Matin et al. | |
| 4,987,682 | A | | 1/1991 | Minnick | |
| 5,054,198 | A | | 10/1991 | Gmoch | |
| 5,241,750 | A | | 9/1993 | Chomiak | |
| 5,285,574 | A | | 2/1994 | Feltner | |
| 5,386,632 | A | | 2/1995 | Schmidt | |
| 5,406,707 | A | * | 4/1995 | Owens et al. | 30/162 |
| 5,417,704 | A | * | 5/1995 | Wonderley | 30/162 |
| 5,522,135 | A | | 6/1996 | Votolato | |
| 5,581,893 | A | | 12/1996 | Ouellette | |
| 5,613,300 | A | | 3/1997 | Schmidt | |
| 5,647,132 | A | * | 7/1997 | Berns | 30/125 |
| 5,697,157 | A | * | 12/1997 | Votolato | 30/2 |
| 5,852,874 | A | | 12/1998 | Walker | |
| 5,890,290 | A | * | 4/1999 | Davis | 30/2 |
| 6,035,534 | A | | 3/2000 | Abbott | |
| 6,041,505 | A | * | 3/2000 | Chen | 30/162 |
| 6,178,640 | B1 | | 1/2001 | Votolato | |
| 6,308,419 | B1 | * | 10/2001 | Neshat et al. | 30/151 |

* cited by examiner

*Primary Examiner*—Allan N. Shoap
*Assistant Examiner*—Stephen Choi
(74) *Attorney, Agent, or Firm*—Dennis T. Griggs

(57) ABSTRACT

A utility knife and various manufacturing methods for the utility knife. In one embodiment, the utility knife includes: (1) a body having a cutting face and (2) a blade-holding slide mounted for linear movement within the body and having a knife-holding head extendable through an opening in the cutting face. The opening has aparallel opposing sides that diverge toward a cutting direction of the utility knife. The knife-holding head has corresponding aparallel opposing sides that cooperate with the sides of the opening to cause a cutting force exerted on the knife-holding head to wedge the blade-holding slide within the opening and thereby stiffen the knife-holding head with respect to the body during operation of the utility knife. In one embodiment of the present invention, the blade-holding slide resiliently urges the knife-holding head to unwedge when the cutting force is removed therefrom.

9 Claims, 4 Drawing Sheets

UTILITY KNIFE HAVING IMPROVED BLADE CARRIER STRUCTURE AND METHOD OF MANUFACTURE THEREOF

TECHNICAL FIELD OF THE INVENTION

The present invention is directed, in general, to retractable blade utility knives and, more specifically, to a utility knife having an improved retractable blade carrier structure and method of manufacturing the same.

BACKGROUND OF THE INVENTION

Utility knives are specialty knives used throughout various industries to meet a wide range of needs. Some of these needs include cutting tough materials (such as carpet) or strapping surrounding crates, boxes or cartons. However, utility knives are perhaps most commonly used for opening the boxes and cartons themselves.

Both fixed blade and adjustable blade utility knives are well known in the art. However, a significant problem for those who use utility knives arises from the lack of positioning control found in conventional utility knives. Specifically, the knife-holding heads found on prior art utility knives in the prior art fail to maintain positional control of the blade during use. As a result, the knife-holding head in such utility knives have a tendency to wander from the cutting path intended by the worker. This can cause the knife-holding head to wander during cutting of a carton, perhaps such that the products contained in the box are damaged. Moreover, wandering could cause the blade to veer away from the surface to be cut, resulting in the blade cutting an object, or even a person, rather than the intended material.

In addition, prior art utility knives also often fail positively to secure the blade itself in place. Although some prior art utility knives and blades have corresponding notches or apertures to assist in keeping the blade in place, some amount of blade movement inevitably occurs during cutting. Even slight movement of a blade during cutting can cause the blade to chip, crack or completely break when it is inserted into a tough material. As a result, safety issues, the cost of replacing damaged goods and the added cost of replacing chipped or broken blades become significant concerns.

Accordingly, what is needed in the art is a utility knife having an improved retractable blade carrier structure that overcomes the disadvantages of the prior art utility knives described above. In addition, what is needed in the art is a method of manufacturing such a utility knife.

SUMMARY OF THE INVENTION

To address the above-discussed deficiencies of the prior art, the present invention provides a utility knife and various manufacturing methods for the utility knife. In one embodiment, the utility knife includes: (1) a body having a cutting face and (2) a blade-holding slide mounted for linear movement within the body and having a knife-holding head extendable through an opening in the cutting face. The opening has aparallel opposing sides that diverge toward a cutting direction of the utility knife. The knife-holding head has corresponding aparallel opposing sides that cooperate with the sides of the opening to cause a cutting force exerted on the knife-holding head to wedge the blade-holding slide within the opening and thereby stiffen the knife-holding head with respect to the body during operation of the utility knife. In one embodiment of the present invention, the blade-holding slide resiliently urges the knife-holding head to unwedge when the cutting force is removed therefrom.

In one embodiment of the present invention, the blade-holding slide and the body have a plurality of cooperating detents located on adjoining surfaces thereof and the utility knife further comprises a locking release button, passing through a rear surface of the body, that separates the plurality of detents to allow the blade-holding slide to move linearly with respect to the body. In a related embodiment, the blade-holding slide and the body have a plurality of cooperating detents located on adjoining surfaces thereof, the blade-holding slide resiliently maintaining the plurality of cooperating detents in an engaged position to prohibit linear movement of the blade-holding slide with respect to the body.

In one embodiment of the present invention, the utility knife may further include locking and locking release buttons passing through opposing sides of the body and adapted to engage the blade-holding slide, the locking button activatable to cause the blade-holding slide to lock positively with respect to the body, the locking release button activatable to displace the blade-holding slide laterally and allow linear movement of the blade-holding slide with respect to the body only when the locking button is disengaged.

In one embodiment of the present invention, the body has a rear end portion distal from the cutting face that is hooked and configured for holding a fixed blade oriented for cutting a strap. The strap-cutting feature is not required, however.

In one embodiment of the present invention, the utility knife further includes a spring loaded knife guard extending from a second opening in the cutting face proximate the knife-holding head. The knife guard advantageously deflects objects (such as human digits) away from the cutting edge of a knife blade when the cutting face is not deliberately pressed against a surface to be cut.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
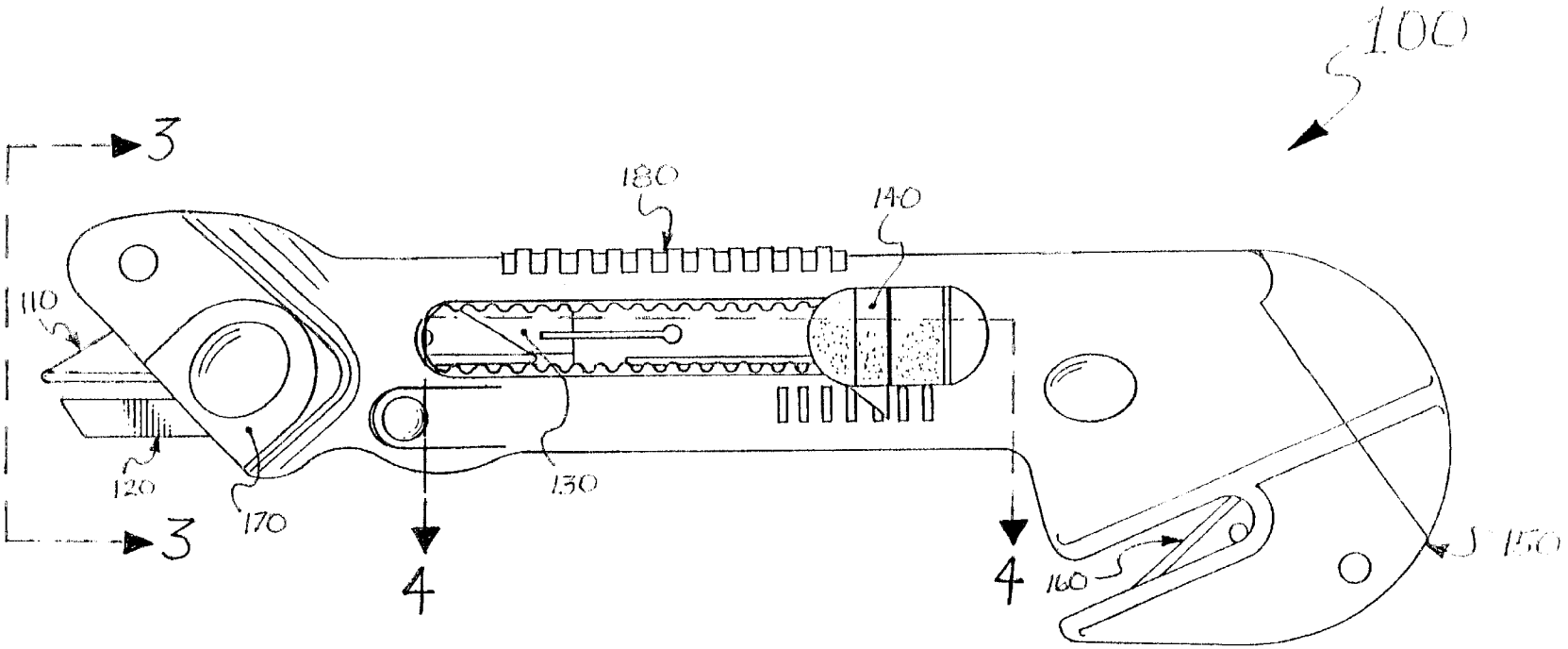
FIG. 1 illustrates a plan view of a utility knife that can incorporate a blade carrier structure constructed according to the principles of the present invention.

Referring initially to FIG. 1, illustrated is plan view of a utility knife 100 that can incorporate a blade carrier structure constructed according to the principles of the present invention. The utility knife 100 includes a utility knife blade 110 and a blade guard 120. The utility knife 100 further includes a blade-holding slide 130 having a knife-holding head 190 at one end. The blade-holding slide 130 is slidable to protrude from the body of the utility knife 100 by a blade extension mechanism 140.

The utility knife 100 further includes a rear end portion 150 distal from the cutting face. The rear end portion is hooked and configured for holding a second utility knife blade 160. The rear end portion 150 is oriented for cutting a strap (not shown). However, the present invention does not require such a strap-cutting feature. The utility knife 100 still further includes a cutting guide 170 and a handle grip 180 for retaining a firm grasp of the utility knife 100 during use.

The blade extension mechanism 140 is used to extend the utility knife blade 110 from the utility knife 100 to a desired position. Once extended and locked into place, the utility knife blade 110 is used to cut open a carton or other material as the task requires. Moreover, the extension mechanism 140 can include a locking device (not illustrated) to secure the extended blade 110 in a desired position.

The blade guard 120 is spring loaded and extends from a second opening in the cutting face proximate the knife-holding head 190. The blade guard 120 advantageously deflects objects (such as human digits) away from the cutting edge of a utility knife blade 110 when the cutting face is not deliberately pressed against a surface to be cut. However, when the utility knife 100 is employed to cut something, the blade guard 120 is retracted out of the way of the utility knife blade 110 by simply pressing the cutting face of the utility knife 100 against the surface to be cut in a somewhat perpendicular direction.

FIG. 1 includes section lines 3—3 and 4—4. These correspond to FIGS. 3 and 4 and will respectively show the cutting face of the utility knife 100 and yield greater detail concerning a secondary locking mechanism used to secure the position of the blade-holding slide 130.

Figure 2:
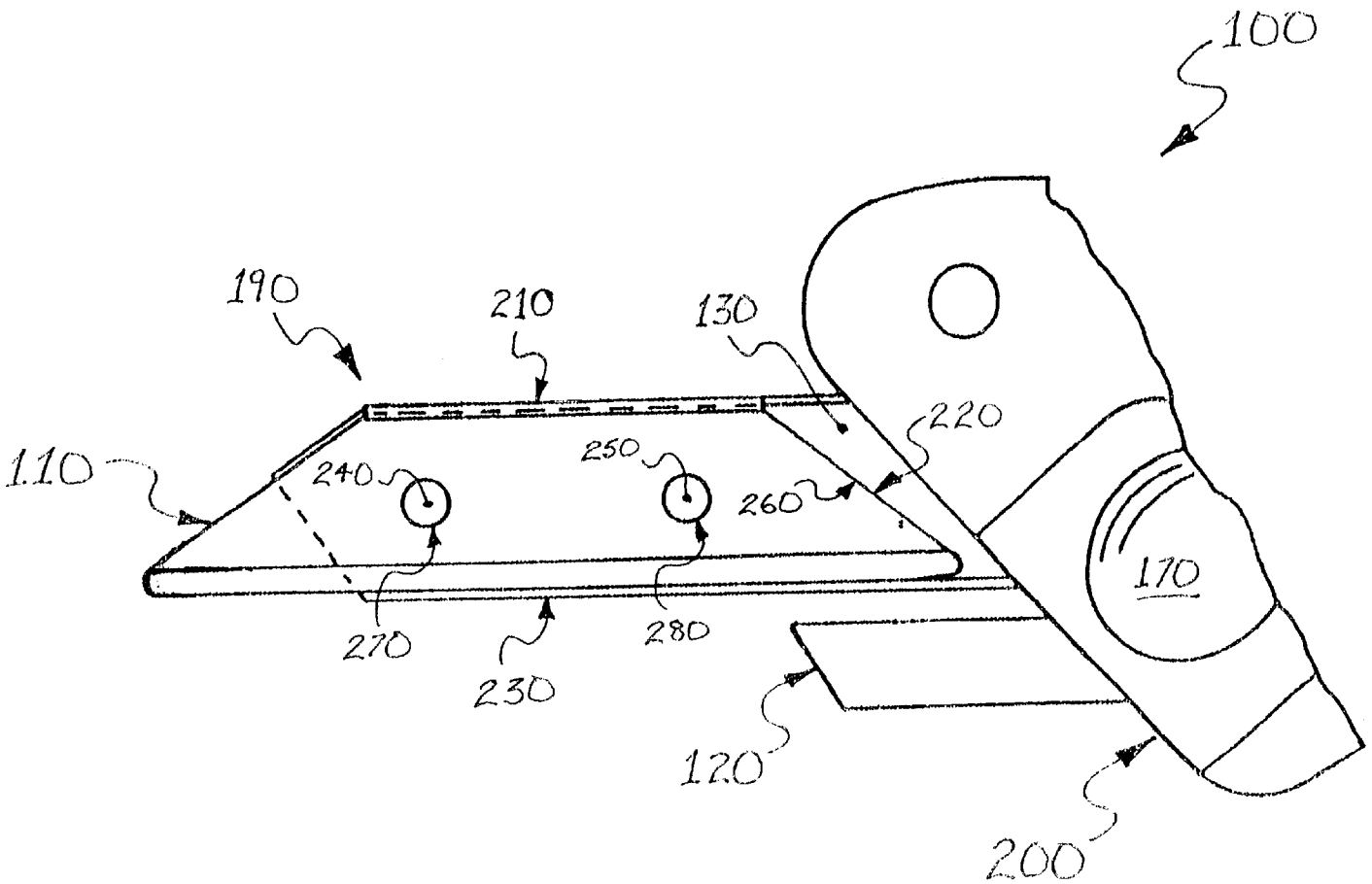
FIG. 2 illustrates an enlarged partial plan view of the utility knife of FIG. 1.

Turning now to FIG. 2, illustrated is an enlarged partial plan view of the utility knife 100 of FIG. 1 showing, in particular, a cutting face 200 thereof. The utility knife 100 includes the knife-holding head 190, located at one end of the blade-holding slide 130, for use with a blade carrier mechanism constructed according to the principles of the present invention. The knife-holding head 190 is illustrated holding a utility knife blade 110. Also illustrated are the blade guard 120 and the cutting guide 170 discussed with respect to FIG. 1.

The blade-holding slide 130 is illustrated as fully extended from the utility knife 100. Specifically, the knife-holding head 190 is extendable through an opening in the cutting face 200. When the knife-holding head 190 is fully extended, the utility knife blade 110 can be easily changed. The knife-holding head 190 is illustrated with special features employed to assist in holding the blade 110 in position, however these features are not necessary to the present invention. These features include a back edge guide 210, an end edge guide 220 and a cutting edge guide 230. The features further include first and second mounting pins 240, 250.

The back edge guide 210 and the cutting edge guide 230 cooperate to prohibit lateral movement of the blade 110. Specifically, the blade 110 is secured between the back edge guide 210 and cutting edge guide 230. In addition, an end edge 260 of the blade 110 rests against the end edge guide 220 to prohibit the blade 110 from retracting into the body of the utility knife 100, relative to the knife-holding head 190.

Finally, the first and second mounting pins 240, 250 register with respective first and second mounting apertures 270, 280 on the blade 110. The mounting pins 240, 250 further assist in holding the blade 110 to the knife-holding head 190 by preventing lateral and longitudinal movement of the blade 110 relative to the knife-holding head 190.

The mounting pins 240, 250 may be composed of resilient plastic and advantageously sized slightly larger than the corresponding first and second mounting apertures 270, 280. In such case, the first and second apertures 270, 280 constrict the mounting pins 240, 250 slightly, allowing the mounting pins 240, 250 to provide some retention force to the blade 110.

Figure 3:
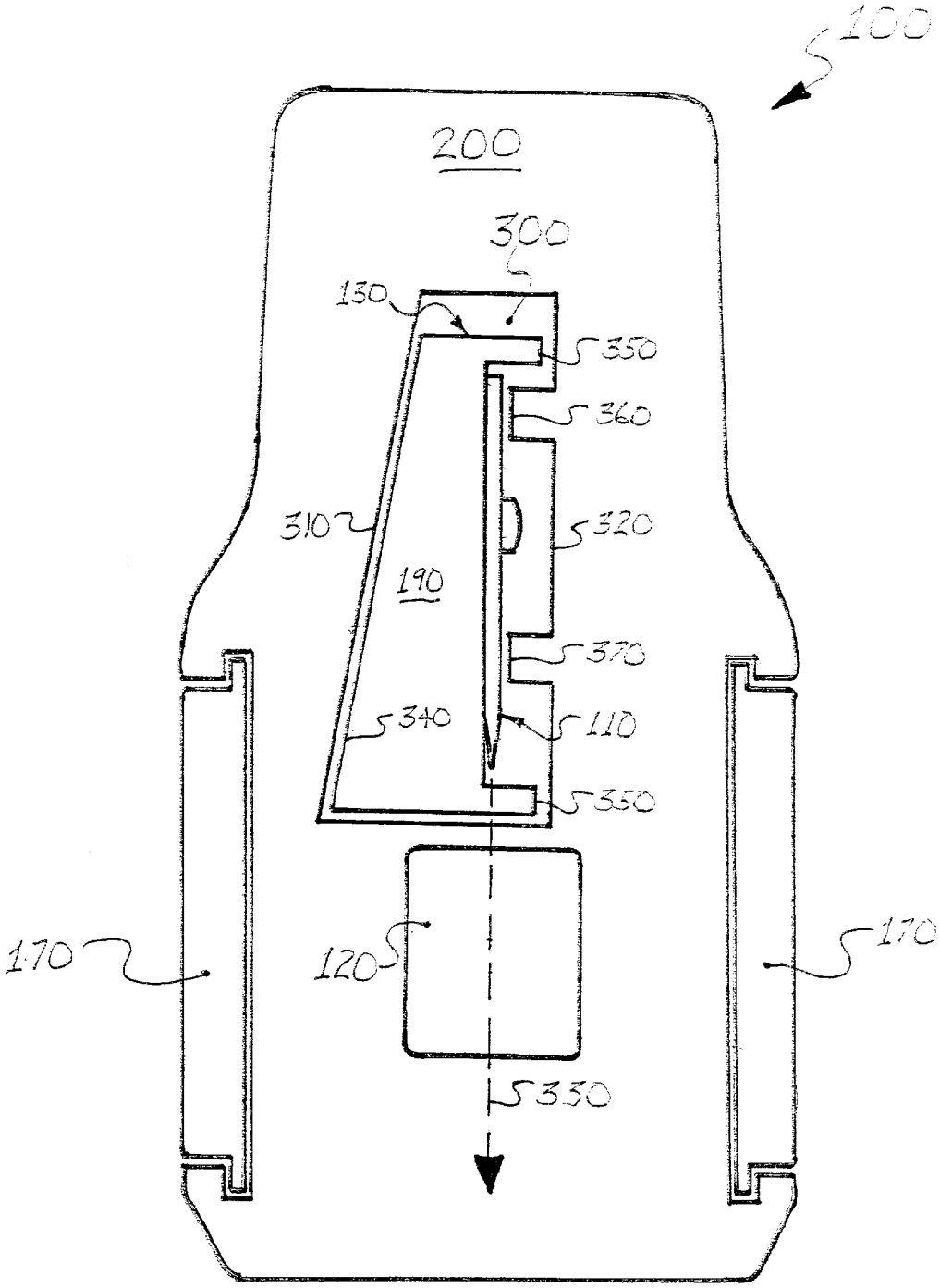
FIG. 3 illustrates a frontside elevational view of the utility knife of FIG. 1 taken along lines 3—3 and showing the cutting face thereof in particular.

Turning now to FIG. 3, illustrated is a frontside elevational view of the utility knife 100 of FIG. 1 taken along lines 3—3 and showing the cutting face 200 thereof in particular. The utility knife 100 includes the utility knife blade 110 and the blade guard 120. The utility knife 100 further includes the knife-holding head 190 located at one end of the blade-holding slide 130. The utility knife 100 still further includes the cutting guides 170 for assistance in making straight cuts.

The cutting face 200 of the utility knife 100 has an opening 300 for passage of the knife-holding head 190 therethrough. The opening 300 has opposing first and second aparallel sides 310, 320. These aparallel sides 310, 320 diverge toward a cutting direction (represented by an arrow 330) of the utility knife 100. The knife-holding head 190 has corresponding opposing first and second aparallel sides 340, 350. These corresponding aparallel sides 340, 350 cooperate with the aparallel sides 310, 320 of the opening 300 to cause a cutting force in the cutting direction 330 exerted on the knife-holding head 190 to wedge the blade-holding slide 130 within the opening 300 of the cutting face 200. As a result, the knife-holding head 190 is stiffened with respect to the body of the utility knife 100 during cutting.

Specifically, when a worker moves the utility knife 100 in the cutting direction 330 and begins to cut, the cutting force urges the blade-holding slide 130 (along with its knife-holding head 190) in a direction opposite the cutting direction 330. The aparallel sides 310, 320 of the opening 300 and the aparallel sides 340, 350 of the knife-holding head 190 interfere and cooperate to impress first and second body protrusions 360, 370 against the utility knife blade 110. By impressing upon the knife blade 110, a blade carrier mechanism manufactured according to the present invention ensures the knife blade 110 is retained during cutting. In addition, because the knife-holding head 190 is securely wedged within the sides 310, 320 of the opening 300, the present invention ensures neither the knife-holding head 190 nor the knife blade 110 itself will tend to wander side-to-side during cutting.

In the illustrated embodiment of the present invention, the blade-holding slide 130 resiliently urges the knife-holding head 190 to unwedge from the opening 300 of the cutting face 200 when the cutting force is removed therefrom. Specifically, the blade-holding slide 130 as illustrated is composed of plastic or other semi-flexible material. Although the blade-holding slide 130 is held somewhat stiffly by the body of the utility knife 100, its semi-flexible composition allows it to flex opposite the cutting direction 330 and become wedged in the opening 300 when cutting. Similarly, the semi-flexible composition of the blade-holding slide 130 allows it to resiliently spring back to its unwedged position once cutting ceases. Once the blade-holding slide 130 springs back to its unwedged position, it can again move easily laterally through the body of the utility knife 100. Although advantageous, this is not a required feature of a blade carrier mechanism constructed according to the principles of the present invention.

Figure 4:
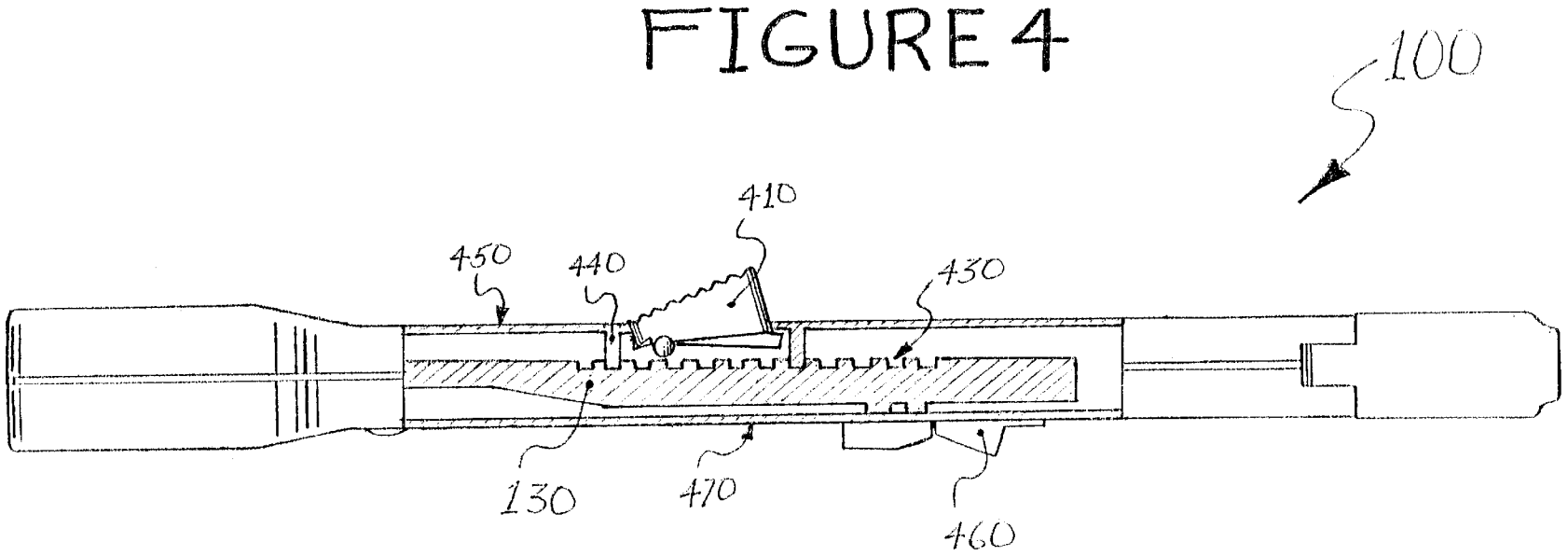
FIG. 4 illustrates a partial sectional view of the utility knife of FIG. 1 taken along lines 4—4.

Turning now to FIG. 4, illustrated is a partial sectional view of the utility knife 100 of FIG. 1 taken along lines 4—4 thereof. The first locking mechanism can be a locking mechanism such as the one described in co-pending patent application Ser. No. 08/906,047, filed on Aug. 5, 1997, entitled "Adjustable Depth Safety Cutter," commonly assigned with the present invention and incorporated herein by reference. Alternatively, the first locking mechanism can be any type of mechanism adapted to positively lock the blade-holding slide 130 into a desired position. Of course, the present invention is not limited to any particular first locking mechanism.

The second locking mechanism includes three basic parts. First, the blade-holding slide 130 includes a plurality of detents (one of which is designated 430) on one side. In addition, a first wall 450 of the body of the utility knife 100 includes a plurality of corresponding detents (one of which is designated 440) located on a surface adjoining the detents 430 on the blade-holding slide 130. Third, the second locking mechanism includes a locking release button 410 for use with the detents 430, 440.

In the illustrated embodiment, the detents 430, 440 on the blade-holding slide 130 and the first wall 450 cooperate by engaging when the blade-holding slide 130 is in a desired position to prohibit linear movement of the blade-holding slide 130 within the body of the utility knife 100. The locking release button 410, which passes through the first wall 450 of the utility knife 100, separates the plurality of detents 430, 440 to allow the blade-holding slide 130 to move linearly when desired. In a related embodiment, the blade-holding slide 130 may be constrained by a spring so that it automatically retracts within the utility knife 100 when the locking release button 410 is depressed. Of course, such a feature is not necessary to the present invention.

The utility knife 100 further includes a locking button 460 for use with the first locking mechanism (not illustrated). The locking button 460 passes through a second wall 470 of the utility knife 100 and is adapted to engage the blade-holding slide 130. The locking button 460 is activatable to cause the blade-holding slide 130 to lock positively in a desired position with respect to the body of the utility knife 100. In the illustrated embodiment, the locking release button 410 is activatable to displace the blade-holding slide 130 laterally and allow linear movement of the blade-holding slide 130 with respect to the body of the utility knife 100 only when the locking button 460 is disengaged.

Although the present invention has been described in detail, those skilled in the art should understand that they can make various changes, substitutions and alterations herein without departing from the spirit and scope of the invention in its broadest form.

What is claimed is:

1. A utility knife, comprising:

a body having a cutting face and an opening formed in said cutting face; and a blade-holding slide mounted for linear movement within said body and having a head portion extendable through the opening in said cutting face for supporting a blade during movement of the blade through a cutting plane, said body including side portions disposed proximate the opening with one of the side portions sloping obliquely relative to the cutting plane, and said head portion including a side surface disposed for wedging engagement against the sloping side portion in response to a cutting force exerted on the head portion.

2. The utility knife as recited in claim 1 wherein said blade-holding slide comprises a body of resilient material for resiliently urging said knife-holding head to release from wedging engagement in response to removal of said cutting force.

3. The utility knife as recited in claim 1 wherein said blade-holding slide includes a plurality of cooperating detents and a manually operable button is mounted on said body for movement between a latched position and a released position, said button being selectively movable into and out of engagement with the cooperating detents to set the position of the slide relative to the body in the latched position and to allow said blade-holding slide to move linearly with respect to said body in the released position.

4. The utility knife as recited in claim 1 wherein said blade-holding slide includes a plurality of cooperating detents, and said blade-holding slide comprising a body of resilient material for resiliently reacting detent engagement forces applied against the slide for maintaining said plurality of cooperating detents in an engaged position.

5. The utility knife as recited in claim 1 further comprising a locking button and a release button projecting through opposing sides of said body and adapted to engage said blade-holding slide, wherein said locking button is manually operable to cause said blade-holding slide to lock positively with respect to said body, and wherein said release button is manually operable to displace said blade-holding slide laterally and allow linear movement of said blade-holding slide with respect to said body only when said locking button is disengaged.

6. A utility knife, comprising:

a plastic body having a cutting face and an opening formed in said cutting face between first and second opposing sidewall surfaces, wherein one of the sidewall surfaces slopes transversely relative to the other sidewall surface; and a plastic slide mounted for linear movement within said body and having a blade-holding head portion extendable through the opening in said cutting face, said blade-holding head portion including a sloping surface that is disposed for wedging engagement against one of the opposing sidewall surfaces for driving the head portion toward the other opposing sidewall surface, thereby forcing a blade carried on the head portion into compressive engagement against the other opposing sidewall surface in response to a cutting force exerted on said head portion and thereby stiffen said blade and head portion with respect to said body during a cutting operation.

7. The utility knife as recited in claim 6 wherein said blade-holding slide and said body have a plurality of cooperating detents located on adjoining surfaces thereof, respectively, and said utility knife further comprises a locking release button, passing through a rear surface of said body, that is engagable with said plurality of detents to fix the position of the slide relative to the body and releasable from said detents to allow said blade-holding slide to move linearly with respect to said body.

8. The utility knife as recited in claim 6 wherein said blade-holding slide and said body have a plurality of cooperating detents located on adjoining surfaces thereof, respectively, said blade-holding slide comprising a body of resilient material for reacting detent engagement forces applied against the slide for resiliently maintaining said plurality of cooperating detents in an engaged position to prohibit linear movement of said blade-holding slide with respect to said body.

9. The utility knife as recited in claim 6 further comprising a locking button and a release button passing through opposing sides of said body and adapted to engage said blade-holding slide, said locking button being manually actuatable to cause said blade-holding slide to lock positively with respect to said body, said release button being manually actuatable to displace said blade-holding slide laterally and allow linear movement of said blade-holding slide with respect to said body only when said locking button is disengaged.

* * * * *